United States Patent [19]

Hikichi et al.

[11] Patent Number: 4,896,550

[45] **Date of Patent: * Jan. 30, 1990**

[54] CONSTRUCTION OF STARTER MOTOR FOR TAKING OFF POWER TO OUTSIDE

[75] Inventors: Koichi Hikichi, Higashi-Kurume; Hideyuki Minami, Kiryu, both of Japan

[73] Assignees: Mitsuba Electric Mfg. Co., Ltd., Gunma; Honda Giken Kogyo Kabushiki Kaisha, Tokyo, both of Japan

[ * ] Notice: The portion of the term of this patent subsequent to Jan. 30, 2007 has been disclaimed.

[21] Appl. No.: 166,888

[22] Filed: Mar. 11, 1988

[30] Foreign Application Priority Data

Apr. 13, 1987 [JP] Japan ..... 62-90127

[51] Int. Cl.[4] ..... F02N 15/02

[52] U.S. Cl. ..... 74/6; 74/7 E; 74/674; 74/768

[58] Field of Search ..... 74/6, 7 E, 665 GA, 665 S, 74/665 K, 768, 674

[56] References Cited

U.S. PATENT DOCUMENTS

| | | | |
|---|---|---|---|
| 1,891,868 | 12/1932 | Cablom | 74/7 |
| 2,900,848 | 8/1959 | Henn-Collins | 74/768 |
| 2,946,326 | 7/1960 | Bates et al. | 74/6 |
| 3,100,405 | 8/1963 | Brass | 74/665 K |
| 4,161,126 | 7/1979 | Winzeler | 74/674 |
| 4,251,987 | 2/1981 | Adamson | 60/39.75 |

FOREIGN PATENT DOCUMENTS

| | | | |
|---|---|---|---|
| 1108675 | 1/1956 | France | 74/768 |
| 1062459 | 12/1983 | U.S.S.R. | 74/674 |

*Primary Examiner*—Rodney H. Bonck
*Assistant Examiner*—Scott Anchell
*Attorney, Agent, or Firm*—Rodman & Rodman

[57] ABSTRACT

A construction of a starter motor for taking off the power to the outside, is operable wherein the power from the starter motor can be taken off as the externally operating section other than the power of an engine. The starter motor includes a first reduction mechanism having a motor shaft as an input shaft. The motor shaft transmits power to a coaxial output shaft. A pinion gear is provided on the engine side of the first output shaft in association with a ring gear. A second reduction mechanism utilizes the first output shaft as an input shaft, to transmit power to a second output shaft. The second output shaft is rotatably coupled onto the first output shaft and coaxial therwith, to permit the power to be taken off to the outside near the pinion gear. The first and second reduction mechanisms each include a sun gear provided on the input shaft, an internal gear and a plurality of planetary gears provided between the sun gear and the internal gear and being mesh with the both gears. The first and second reduction mechanism are axially arranged within a first and second bracket which are integrally fixed to each other by bolts.

7 Claims, 1 Drawing Sheet

CONSTRUCTION OF STARTER MOTOR FOR TAKING OFF POWER TO OUTSIDE

BACKGROUND OF THE INVENTION

1. Field of the Invention

This invention relates to a construction of a starter motor for taking off the power to the outside thereof, wherein the starter motor can be used as a power source other than the engine start.

2. Related Art Statement

A starter motor for carrying out the engine start has heretofore been provided for the specialized functional purpose. Accordingly, the starter motor has been useless when it is not engaged in the engine start, because it is otherwise not in operation.

In Japanese Patent Laid-Open No. 56-6065 or Japanese Utility Model Laid-Open No. 56-165988 for example power is taken off from a transmission of the starter. However, according to these inventions, an output shaft and a motor shaft are not coaxial with each other and the provision of the two shafts is necessary. Thus the starter motor as a whole is inevitably large-sized, and moreover, such a construction must be adopted that the engine start is carried out at one side of the output shaft and the power is taken off to the outside at the other side of the output shaft, thereby presenting such a disadvantage that assembling properties are deteriorated to a considerable extent.

Furthermore, as shown in Japanese Utility Model Laid-Open No. 59-86868, it is known to provide a starter motor wherein the output shaft is coaxial with the motor shaft. In this case, such a special motor construction is necessitated that the output shaft is rotatably penetrated through the motor shaft, a arrangement that is not practical.

SUMMARY OF THE INVENTION

This invention has been developed to obviate the above-described disadvantages of the related art and has as its object the provision of a construction of a starter motor for taking off the power to the outside. To achieve the above-described object, the present invention is directed to a construction of a starter motor for taking off the power to the outside, wherein the starter motor includes a first reduction mechanism having a motor shaft as an input shaft, for outputting the power from a first output shaft coaxial with the input shaft, a pinion gear provided on the first output shaft in association with a ring gear on the side of an engine and a second reduction mechanism having the first output shaft as an input shaft, for outputting the power from a second output shaft, and further, the second output shaft is rotatably coupled onto the first output shaft and made coaxial therewith, so that the power can be taken off on the side of the pinion gear. The reduction mechanisms are compactly arranged within brackets of the starter motor.

According to the present invention with the abovedescribed arrangement, the starter motor is the one, wherein the power can be taken off from the transmission system to the outside, and yet, the first output shaft for starting the engine and the second output shaft for taking off the power to the outside are made coaxial with the motor shaft, and the power can be outputted from the same side.

BRIEF DESCRIPTION OF THE DRAWING

The above and other object and features of the present invention will become more apparent when referred to the following description given in conjunction with the accompanying drawing, FIG. 1.

DESCRIPTION OF THE PREFERRED EMBODIMENT

Figure 1:
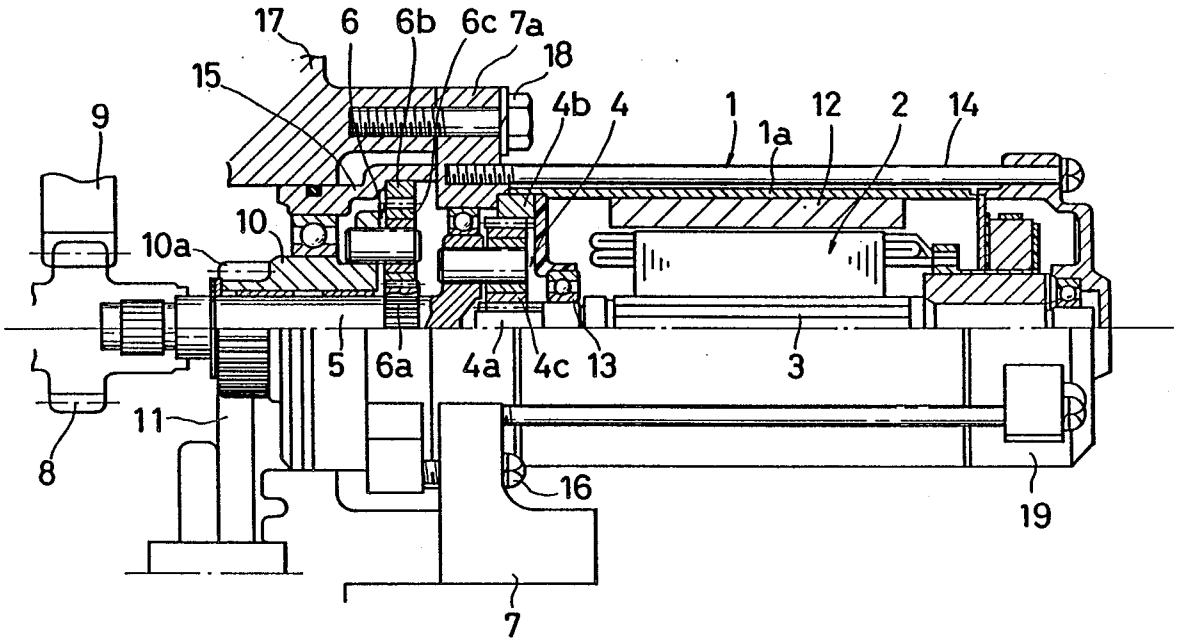
FIG. 1 is a partially broken away front view of the starter motor showing one embodiment of a construction of the starter motor for taking off the power to the outside thereof.

One embodiment of the present invention will hereunder be described with reference to the drawing.

Referring to the drawing, designated at 1 is a motor section of the starter motor. A motor shaft 3 constituting an armature 2 is rotatably supported on the motor section 1, and a gear 4*a* is provided on one end of the motor shaft 3. More specifically, this gear 4*a* forms a sun gear as being an input gear of a first reduction mechanism 4 constituted by a planetary gear mechanism. And, the first reduction mechanism 4 is constituted by a first gear means including the sun gear 4*a*, an internal gear 4*b* fixed on the inner peripheral surface of first bracket 7 and a plurality of planetary gears 4*c* being in meshing engagement between the both gears 4*a* and 4*b*. The planetary gears 4*c* are rotatably supported by a collar portion of a first output shaft 5 provided coaxially with the motor shaft 3, and the planetary gears 4*c* revolve around the sun gear 4*a* while rotating about their axes. Thus, when the motor is rotated, rotation of the motor is transmitted to the first output shaft 5 at a reduced speed. A pinion gear 8 in mesh with a ring gear 9 on the engine's side is integrally formed on the forward end portion of the first output shaft 5, so that the rotation of the first output shaft 5 can start the engine.

On the other hand, denoted at 6 is a second reduction mechanism, which has a gear provided on the first output shaft 5 as a sun gear 6*a* and is constituted by this sun gear 6*a*, an internal gear 6*b* fixed on the inner peripheral surface of a gear cover, i.e. second bracket 15, and a plurality of planetary gears 6*c* in meshing engagement between the both gears 6*a* and 6*b*. The gears 6*a*, 6*b* and 6*c* are thus gear means included in the second reduction mechanism and can be referred to as a second gear means. The planetary gears 6*c* revolving around the sun gear 6*a* while rotating about the axes thereof are rotatably supported by a collar portion of a second output shaft 10. Thus, in the second reduction mechanism 6, input power is transmitted from the sun gear 6a, is reduced in speed and transmitted as a power output from the second output shaft 10. This second output shaft 10 is rotatably coupled onto the first output shaft 5 and coaxial therewith. The first output shaft 5, when rotated by the motor as described above, causes rotation of the second reduction mechanism 6 having the first output shaft 5 as an input shaft and the second output shaft 10 is rotated at a reduced speed. An output gear 10*a* is integrally formed at the forward end portion of this second output shaft 10 and in mesh with an input gear 11 on the side of an externally operating section such as for example a pump, whereby the second output shaft 10 functions as a shaft for taking off the power to the outside on the side of the pinion gear 8.

Incidentally, this embodiment shows that no one-way clutches are provided in the two power transmitting systems, which extend from the motor shaft 3 to the output shafts 5 and 10. In this case, suitable clutch mechanisms such as one-way clutches are provided in the transmitting system extending from the ring gear 9 to the engine and in the transmitting system extending from the input gear 11 to the externally operating section, respectively, so that the both transmitting systems do not interfere with each other when the engine is started and the externally operating section is operated. Referring to the drawing, designated at 12 is a permanent magnet, 13 a bearing and 14 a through bolt.

In the preferred embodiment, first bracket 7 wherein the first reduction mechanism 4 is contained and second bracket 15 wherein the second reduction mechanism 6 is contained are integrally fixed to each other through bolts 16. Within this integrated bracket assembly, the first and second reduction mechanisms 4, 6 are axially arranged.

Furthermore, the first bracket 7 has a fitting portion *7a* fitted to a construction part 17 of the engine, and fixed to the engine by fixing bolts 18 at this fitting portion *7a*.

Further, said second bracket 15 is faucet joined to the construction part 17 of the engine.

Still further, third bracket 19 positioned on the right in FIG. 1 is fixed to said first bracket 7 by said through bolts 14 to hold therebetween a yoke *1a*.

In the embodiment according to the present invention, which is constructed as described, a starter switch, not shown, is turned ON to start the engine. More specifically, when the starter switch is turned ON to rotate the motor shaft 3, the rotation is reduced in speed and transmits a power output from the first output shaft 5, to the pinion gear 8 provided on this first output shaft 5 and through the ring gear 9 being in mesh therewith, so that the engine is started.

On the other hand, in order to operate the externally operating section, when a switch for the operation is turned ON to rotate the motor, the motor rotation causes rotation of a transmission system including the motor shaft 3, the first reduction mechanism 4, the first output shaft 5 and the second reduction mechanism 6, where two stage speed reductions are performed, and the power is transmitted from the second output shaft 10, so that the externally operating section can be operated through the input gear 11 being in mesh with the output gear 10a provided on this second output shaft 10.

As described above, according to the present invention, the starter motor is effectively used for the engine start, and moreover, as a power source for the externally operating section. In this arrangement the second output shaft 10, as the output shaft for the externally operating section, is coupled onto the first output shaft 5 as the output shaft for the engine start and the both outputs shafts 5 and 10 are coaxial with the motor shaft 3. Because of this, necessity of the two shaft arrangement of the conventional example, wherein the motor shaft and the output shaft are arranged in parallel to each other, is eliminated, and one shaft arrangement can be adopted. Moreover, the second output shaft 10 as being the output shaft for the externally operating section has a double shaft construction wherein the second output shaft 10 is coupled onto the first output shaft 5, so that the power can be taken off on the side of the pinion gear 8 by assembling the second output shaft 10, the second reduction mechanism 6, the first output shaft 5, the first reduction mechanism 4 and the motor section 1 to one another in the axial direction, thus simplifying the assembling properties to a considerable extent and improving the reliability.

Moreover, in this embodiment, the first reduction mechanism 6 necessary for starting the engine can be effectively utilized as it is as the second reduction mechanism for the second output shaft 10, whereby, accordingly, necessity of providing an excessive reduction mechanism on the side of the second output shaft is eliminated, thus permitting a simple construction to render the starter motor light in weight and compact in size.

Furthermore, the present invention is not necessarily limited to the above embodiment, and, needless to say, other modifications can be achieved without departing from the gist of the present invention.

In short, in the present invention, first and second reduction mechanisms are axially arranged within a pair of brackets which are integrally fixed to each other with fastening means so that it is possible to obtain a compact unit structure and assembling work can be made simple and easy. Further, since the present invention is constructed as described above, the power from the starter motor can be effectively used not only for the engine start but also as the power source for the externally operating section, and moreover, the respective output shafts are coaxial with the motor shaft, so that the starter motor can be rendered light in weight and compact in size as the starter motor of one shaft arrangement without adopting the conventional two shaft arrangement. Furthermore, the double shaft construction, wherein the second output shaft for the externally operating section is coupled onto the first output shaft for the engine start, is adopted, whereby assembling is successively made from the second output shaft in the axial direction, whereby the power can be taken off from the second output shaft on the side of the pinion gear, so that the assembling properties can be improved to a considerable extent and the first reduction mechanism can be effectively used as the reduction mechanism when the power is taken off to the outside. According to the present invention, it is possible to produce in large quantities the starter motors capable of taking off the power to the outside, being high in the reliability, compact in size and low in cost.

What is claimed is;

1. A construction of a starter motor for taking off power to an outside, wherein;

said motor comprises a first reduction mechanism having a motor shaft as an input shaft, a first output shaft coaxial with said input shaft, a pinion gear provided on said first output shaft which is engageable directly or indirectly with a ring gear of an engine, the pinion gear being located on a side of the motor defined as a first side, and first gear means in the first reduction mechanism for transmitting power from said input shaft to the first output shaft, and a second reduction mechanism having said first output shaft as an input shaft, a second output shaft and second gear means in the second reduction mechanism for transmitting power from the first output shaft to the second output shaft, said second output shaft is hollow to be coaxially fitted onto said first output shaft to permit relative rotation between said first output shaft and said second output shaft, so that the power can be taken off on the first side of said motor at said pinion gear, and;

first and second brackets within which said first and second reduction mechanisms are axially arranged.

2. The construction of a starter motor for taking off power to an outside as set forth in claim 1, wherein said first bracket includes an inner peripheral surface and said first gear means comprises:

a sun gear provided on one end of said motor shaft;

an internal gear provided on the inner peripheral surface of said first bracket and a plurality of planetary gears provided between said sun gear and said internal gear so as to be in mesh with said sun gear and said internal gear.

3. The construction of a starter motor for taking off power to an outside thereof as set forth in claim 2, wherein said planetary gears are rotatably supported by said first output shaft, and said planetary gears revolve around said sun gear while rotating about their axes, whereby rotation of said motor is transmitted from the motor shaft to said first output shaft at a reduced speed.

4. The construction of a starter motor for taking off power to an outside as set forth in claim 1, wherein said second gear means includes a gear provided on said first output shaft as the input of the second reduction mechanism and said first reduction mechanism additionally constitutes a reduction mechanism for said second output shaft transmitting the power from the motor shaft to the second reduction mechanism.

5. The construction of a starter motor for taking off the power to an outside as set forth in claim 1, wherein said second bracket has an inner periphery and said gear means comprises:

a sun gear provided on said first output shaft;

an internal gear provided on the inner periphery of said second bracket; and a plurality of planetary gears provided between said sun gear and said internal gear so as to be in mesh with said sun gear and said internal gear.

6. The construction of a starter motor for taking off the power to an outside as set forth in claim 5, wherein said planetary gears are rotatably supported by said second output shaft, and said planetary gears revolve around said sun gear while rotating about their axes, whereby an input from said first output shaft is transmitted from said sun gear and through said planetary gears, and output from said second output shaft at a reduced speed.

7. The construction of a starter motor for taking off power to an outside as set forth in claim 1, wherein an output gear is provided on an end portion of said second output shaft on the first side of said pinion gear and said output gear for engagement with an input gear is of an externally operating section.

* * * * *